US008123033B2

(12) United States Patent
Goldburt

(10) Patent No.: US 8,123,033 B2
(45) Date of Patent: Feb. 28, 2012

(54) CONTAINER FOR BEVERAGES

(76) Inventor: Tim Goldburt, Ardsley, NY (US)

( * ) Notice: Subject to any disclaimer, the term of this patent is extended or adjusted under 35 U.S.C. 154(b) by 0 days.

(21) Appl. No.: 12/655,442

(22) Filed: Dec. 29, 2009

(65) Prior Publication Data

US 2011/0155603 A1 Jun. 30, 2011

(51) Int. Cl.
*B65D 85/00* (2006.01)

(52) U.S. Cl. ..... 206/459.1; 40/310

(58) Field of Classification Search ..... 206/459.1, 206/459.5; 40/310, 5, 455, 446, 902
See application file for complete search history.

(56) References Cited

U.S. PATENT DOCUMENTS 5,168,646 A * 12/1992 Dippong et al. ..... 40/442
5,884,421 A * 3/1999 Key ..... 40/306
6,393,401 B1 * 5/2002 Loudermilk et al. ..... 704/272
6,588,131 B2 * 7/2003 O'Connell, Jr. ..... 40/446
6,762,734 B2 * 7/2004 Blotky et al. ..... 345/45
7,000,343 B1 * 2/2006 Teichman ..... 40/436
7,383,650 B2 * 6/2008 Duesler ..... 40/310
7,413,082 B2 * 8/2008 Adler et al. ..... 206/534
2003/0099158 A1 * 5/2003 De la Huerga ..... 368/10
2003/0226298 A1 * 12/2003 Bjork ..... 40/310
2004/0206828 A1 * 10/2004 Harris ..... 235/487
2005/0229449 A1 * 10/2005 Shepley ..... 40/306
2006/0118507 A1 * 6/2006 Feldman ..... 215/12.1
2008/0034628 A1 * 2/2008 Schnuckle ..... 40/310
2009/0293328 A1 * 12/2009 Bull ..... 40/310
2010/0101124 A1 * 4/2010 Sorensen ..... 40/306

* cited by examiner

*Primary Examiner* — Jacob K Ackun
(74) *Attorney, Agent, or Firm* — I. Zborovsky

(57) ABSTRACT

A container for beverages has a container body, an electronic device provided with a display for displaying electronic images, and an additional element for holding the electronic device on the container body and including an element connected with the electronic device so as to form together a circumferentially extending unit which is fittable on a surface of the container body and tightly held on the latter.

9 Claims, 3 Drawing Sheets

CONTAINER FOR BEVERAGES

BACKGROUND OF THE INVENTION

The present invention relates to containers for beverages.

More particularly, it relates to containers for beverages, which are provided with additional devices attached to them.

Some of such containers for beverages are disclosed in our patent application Ser. Nos. 11/588,494; 11/821,334; 11/821,335; 11/828,349; 12/454,862; 12/454,863; 12/590,000 and 12/590,013 which are incorporated here by reference thereto and form a basis for claim to priority.

It is believed that this containers for beverages can be further improved.

SUMMARY OF THE INVENTION

Accordingly, it is an object of the present invention to provide a container for beverages, which is a further improvement of existing containers.

In keeping with these objects and with others which will become apparent hereinafter, one feature of the present invention resides, briefly stated, in a container for beverages, comprising a container body; an electronic device provided with a display for displaying electronic messages; and means for holding said electronic device on said container body and including an additional element connected with said electronic device so as to form together a circumferentially extending unit which as a whole is fittable on a surface of said container body and tightly held on the latter.

The unit can extend over the whole circumference or over only a part of it. The additional element can be stretchable, for example, composed of rubber.

The additional element can be connected with said electronic device detachably or non-detachably.

The electronic device has microprocessing means for generating electronic messages, and control means for controlling operation of the microprocessing means.

The control means select said messages in an increasing order and in a decreasing order, and two control buttons can be provided for selecting the messages in the increasing order and the decreasing order.

The control means is formed so that when a respective one of the buttons is pressed the images are displayed in the increasing order or in the decreasing order correspondingly, but when a pressure on the buttons is removed the selection of the messages is stopped and the selected messages are displayed on said display permanently.

The control means can be formed so that the display turns off automatically, or a time of displaying the messages before turning off is adjusted by the control means, or the display can turn off or can stay operating without turning off.

The messages can be video messages including letters, symbols, running light. These video messages can be accompanied by audio messages. The generation of the video messages and/or audio messages is controlled by the microprocessor means and control means.

The device further can be provided with battery means for battery operated power supply to the microprocessor means and the control means. Also it can be provided with a cable pluggable into a source of alternating current, and means for converting alternating current into direct current for power supply to the microprocessor means and the control means.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
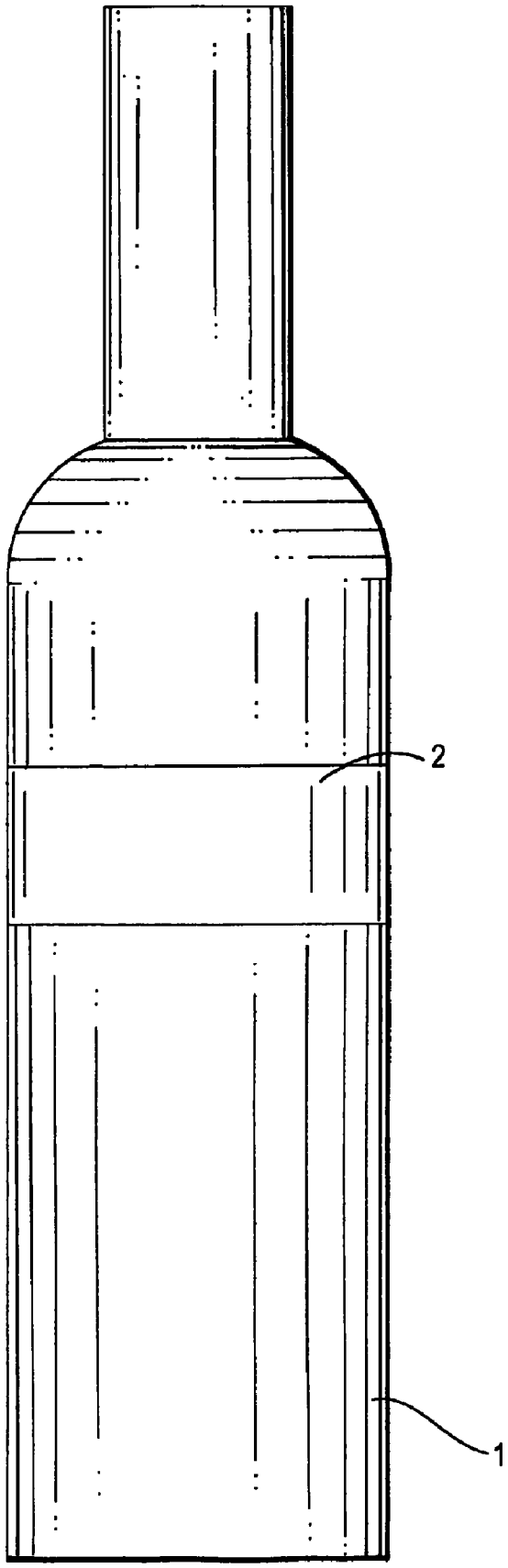
FIG. 1 is a side view showing a container for beverages with an electronic device in accordance with the present invention.
Figure 2A:
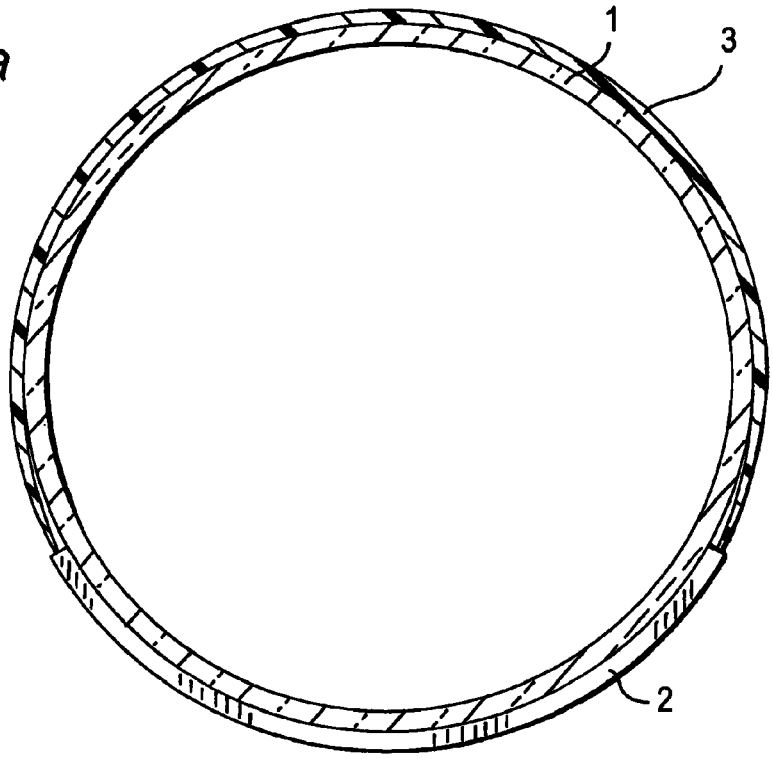
FIG. 2 is a view showing the cross-section of the container for beverages with the electronic device in accordance with the present invention.
Figure 2B:
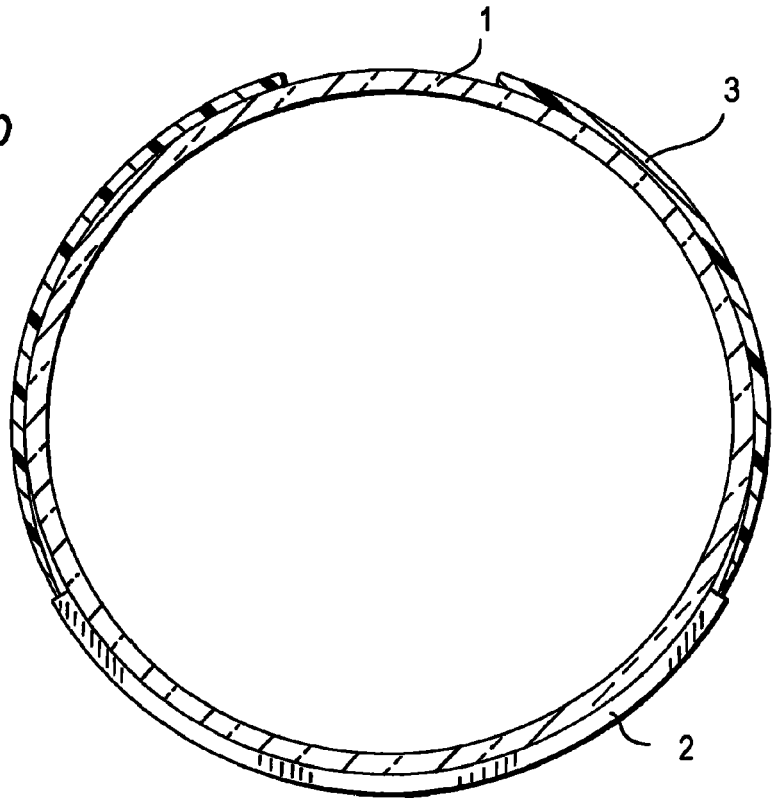
Figure 3:
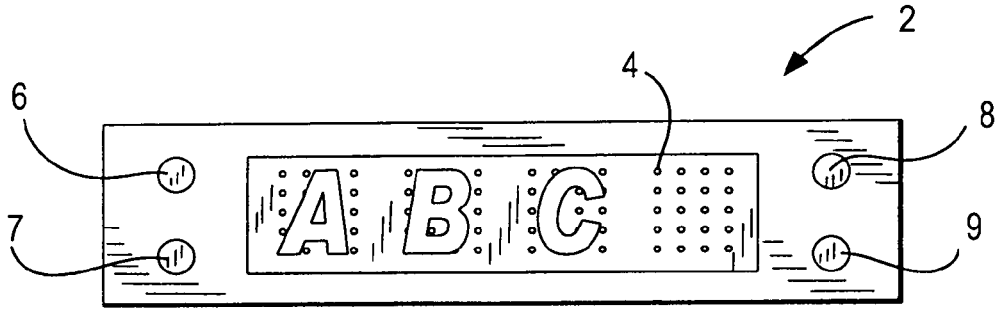
FIG. 3 is an enlarged view of a front surface of the electronic device of the inventive container for beverages.
Figure 4:
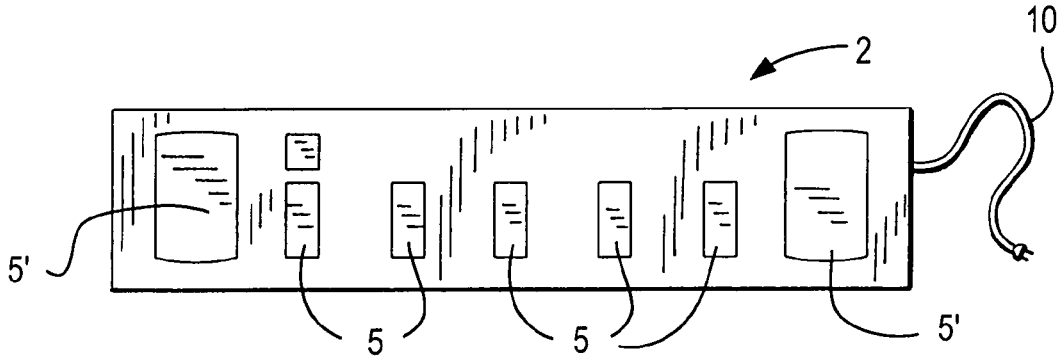
FIG. 4 is a view showing a back side of the electronic device of the inventive container for beverages.

A container for beverages in accordance with the present invention has a container body which is identified with reference numeral 1.

The container further has an electronic device provided with a display for displaying electronic messages, identified with reference numeral 2, and capable of displaying video messages composed of letters, numerals, images, running images, lights, etc.

The inventive container further has means for holding said electronic device on said container body and including an additional element 3 connected with said electronic device so as to form together a circumferentially extending unit which as a whole is fittable on said container body and tightly held on the latter element.

The whole unit can be completely circumferentially closed, or partially open.

The electronic device can further have a display 4. The display 4 can include a plurality of LEDs or OLEDs, arranged in several rows and columns.

The electronic device 3 further has a microprocessor 5. The microprocessor 5 is designed to provide several functions. It has a memory in which individual elements such as letters, numbers, symbols are stored, and in which preliminarily selected messages can be stored as well. The microprocessor also has means for generating on the display corresponding elements (letters, numerals, symbols, light, running lights, etc.)

The additional element 3 can be connected with said electronic device detachably or non-detachably. The detachable connection can be carried out for example by interengaging projections and holes. The non-detachable connection can be done for example by welding, fusing, etc.

The electronic device further has control means which include an on/off button 6, an entry button 7, an up button 8, and a down button 9.

The electronic device further has control means which include an on/off button 6, an entry button 7, an up button 8, and a down button 9.

In accordance with the present invention, the microprocessing means or microprocessor 5 is designed so that it provides generation on the display 4 of messages including running light messages. The electronic device 3 also has batteries 11.

The electronic device of the electronic container for beverages operates in the following manner.

When the on/off button is pressed by a user, a preliminarily provided message is displayed on the display 4 as a running light message. By pushing the button 8 or the button 9 the other preliminarily provided message can be selected correspondingly in an ascending order or in a descending order.

In accordance with the present invention, a user can compose a new message to be displayed on the display 4. For this purpose the entry button 7 is pressed, and by pressing the button 8 or 9 letters, numbers, or symbols successively appear on the display 4. in order to memorize the corresponding letter, number or symbol, the entry button 7 is pressed again. By repeating this operation a corresponding number of times, a corresponding message can be composed, and then the on/off button is pressed to memorize this message. This light message which is thusly selected by the user is then displayed on the display 4.

The letters to be selected can be letters of any alphabet, the numbers to be selected can be numbers of any calculating system, and the symbols can be any symbols such as a star, a flag, a geometric figure, a face, etc.

The electronic device can be provided with an electrical cable 10 with AC/DC convertor to be plugged in a power source to operate the device.

The control and the microprocessor means is formed so that when a respective one of the buttons 8 or 9 is pressed the images are displayed in the increasing order or in the decreasing order correspondingly, but when a pressure on the buttons is removed the selection of the messages is stopped and the selected messages are displayed on said display.

The control means and the microprocessor can be also formed so that the display turns off automatically.

Furthermore, the control means and the microprocessor can be formed so that a time of displaying the messages before turning off is adjustable by the control means.

Also, the control means can be formed so that said display can turn off or can stay operating without turning off.

It will be understood that each of the elements described above, or two or more together, may also find a useful application in other types of constructions differing from the type described above.

While the invention has been illustrated and described as embodied in a container for beverages, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A container for beverages, comprising a container body having a cylindrical wall with an outer circumferential surface extending around a vertical axis: an electronic device provided with a display for displaying electronic images: and means for holding said electronic device on said container body and including an additional element connected with said electronic device so as to form together a circumferentially extending unit which as a whole is fitted on outer circumferential surface of said cylindrical wall of said container body so as to circumferentially surround said outer circumferential surface of said cylindrical wall of said container body and tightly held on the latter and which includes said electronic device extending over one part of said outer circumferential surface of said cylindrical wall of said container body and said additional element extending over another adjoining part of said outer circumferential surface of said cylindrical wall of said container body, wherein said electronic device has microprocessing means for generating said electronic image, and control means for controlling operation of said microprocessing means.

2. A container for beverages as defined in claim 1, wherein said control means select said messages in an increasing order and in a decreasing order.

3. A container for beverages as defined in claim 2, wherein said control means include two control buttons for selecting the messages in the increasing order and the decreasing order.

4. A container for beverages as defined in claim 3, wherein said control means and said microprocessor means are formed so that when a respective one of said buttons is pressed the images are displayed in the increasing order or in the decreasing order correspondingly, but when a pressure on said buttons is removed the selection of the messages is stopped and the selected messages are displayed on said display.

5. A container for beverages as defined in claim 1, wherein said control means and said microprocessor means are formed so that said display turns off automatically.

6. A container for beverages as defined in claim 1, wherein said control means and said microprocessor means are formed so that a time of displaying the messages before turning off is adjusted by said control means.

7. A container as defined in claim 1, wherein said control means and said microprocessor means are formed so that said display can turn off or can stay operating without turning off.

8. A container as defined in claim 1; and further comprising battery means for battery operated power supply to said microprocessor means and said control means.

9. A container as defined in claim 1; and further comprising means for converting A/C current into D/C current, a cable pluggable into a source of alternating current, and means for converting alternating current into direct current for power supply to said microprocessor means and said control means.

* * * * *